US010888152B2

(12) United States Patent
De Bardonneche

(10) Patent No.: US 10,888,152 B2
(45) Date of Patent: Jan. 12, 2021

(54) APPLICATOR DEVICE FOR APPLYING A FLUID OR PASTY PRODUCT TO KERATIN FIBRES

(71) Applicant: MONTAIGU DEVELOPPEMENT, Chambourcy (FR)

(72) Inventor: Eric De Bardonneche, Courpalay (FR)

(73) Assignee: SOCIETE INDUSTRIELLE DE MATIERES PLASTIQUES, Tigery (FR)

( * ) Notice: Subject to any disclaimer, the term of this patent is extended or adjusted under 35 U.S.C. 154(b) by 479 days.

(21) Appl. No.: 15/749,220

(22) PCT Filed: Jul. 25, 2016

(86) PCT No.: PCT/FR2016/051933
§ 371 (c)(1),
(2) Date: Jan. 31, 2018

(87) PCT Pub. No.: WO2017/021620
PCT Pub. Date: Feb. 9, 2017

(65) Prior Publication Data

US 2018/0220785 A1 Aug. 9, 2018

(30) Foreign Application Priority Data

Jul. 31, 2015 (FR) ..... 15 57408

(51) Int. Cl.
*A46B 9/02* (2006.01)
*A45D 34/04* (2006.01)

(52) U.S. Cl.
CPC ..... *A46B 9/021* (2013.01); *A45D 34/042* (2013.01); *A46B 2200/106* (2013.01); *A46B 2200/1053* (2013.01)

(58) Field of Classification Search
CPC ..... A45D 34/0423; A45D 34/043; A45D 34/045; A45D 34/046; A45D 34/048;
(Continued)

(56) References Cited

U.S. PATENT DOCUMENTS 4,461,312 A 7/1984 Gueret
4,964,429 A 10/1990 Cole
(Continued)

FOREIGN PATENT DOCUMENTS

CN 102939029 2/2012
EP 0875169 11/1998
(Continued)

OTHER PUBLICATIONS

International Search Report dated Oct. 31, 2016 (4 pages including English translation) from PCT Priority Application No. PCT/FR2016/051933.

(Continued)

*Primary Examiner* — Jacqueline T Johanas
*Assistant Examiner* — Thomas Drew Agger
(74) *Attorney, Agent, or Firm* — Barnes & Thornburg LLP; G. Peter Nichols

(57) ABSTRACT

A one-piece applicator device for applying a fluid or pasty product to keratin fibres includes a core that extends along a longitudinal axis XX and at least one flexible stem that is embedded at at least a first and a second point along the longitudinal core, the stem extending substantially along the longitudinal axis XX, spikes being provided on the core and/or on the at least one stem. The core is provided with at least one through-opening and the at least one flexible stem extends substantially in a radial plane and has at least a first and a second curve along its length, such that the stem crosses the at least one opening without contact in order to ensure mobility in a radial plane of the device.

10 Claims, 7 Drawing Sheets

(58) Field of Classification Search
CPC .. A45D 40/262; A45D 40/264; A45D 40/265; A45D 40/267; A45D 24/04; A45D 24/16; A61C 3/005; A61C 15/00; A46B 9/021; A46B 2200/1053; A46B 2200/106
USPC ..... 132/120, 126, 216, 218; D4/128, 130, D4/131, 132, 133, 134, 135; D28/7; 401/129
See application file for complete search history.

(56) References Cited

U.S. PATENT DOCUMENTS

| | | | | |
|---|---|---|---|---|
| 6,067,997 | A | 5/2000 | Gueret | |
| 7,654,270 | B2 | 2/2010 | Gueret | |
| D682,556 | S | 5/2013 | Uresti | |
| 8,746,258 | B2 * | 6/2014 | Malvar | B29C 53/02 132/218 |
| 8,826,923 | B2 | 9/2014 | Caulier | |
| 9,125,474 | B2 | 9/2015 | Gueret | |
| 2008/0083421 | A1 | 4/2008 | Malvar et al. | |
| 2009/0065020 | A1 | 3/2009 | Butcher | |
| 2009/0193602 | A1 | 8/2009 | Dumler | |
| 2010/0192968 | A1 | 8/2010 | Gueret | |
| 2010/0212097 | A1 | 8/2010 | Jeong | |
| 2011/0226276 | A1 | 9/2011 | Limongi | |
| 2012/0294664 | A1 | 11/2012 | Gueret | |
| 2013/0104924 | A1 * | 5/2013 | Higgins | A46B 9/028 132/218 |
| 2013/0319451 | A1 | 12/2013 | Viegas | |
| 2014/0216497 | A1 | 8/2014 | Pires | |
| 2014/0246043 | A1 | 9/2014 | Befve | |
| 2015/0110540 | A1 | 4/2015 | Uresti | |
| 2015/0305476 | A1 | 10/2015 | Malvar et al. | |
| 2015/0305477 | A1 | 10/2015 | Malvar et al. | |
| 2015/0320177 | A1 * | 11/2015 | Pires | A45D 40/265 401/129 |
| 2015/0327655 | A1 | 11/2015 | Kim | |
| 2016/0073767 | A1 | 3/2016 | Sanchez | |
| 2016/0135568 | A1 | 5/2016 | Sanchez | |
| 2016/0157586 | A1 | 6/2016 | Pires | |
| 2016/0360860 | A1 | 12/2016 | Berhault | |
| 2017/0020274 | A1 | 1/2017 | De Bardonneche | |
| 2017/0079410 | A1 | 3/2017 | Crapet | |
| 2017/0318940 | A1 | 11/2017 | Manici | |
| 2017/0360185 | A1 | 12/2017 | De Bardonneche | |

FOREIGN PATENT DOCUMENTS

| | | | | |
|---|---|---|---|---|
| EP | 2198743 | | 6/2010 | |
| FR | 2 505 633 | | 11/1982 | |
| FR | 2 850 549 | | 8/2004 | |
| FR | 2 902 984 | | 1/2008 | |
| FR | 2905243 | | 3/2008 | |
| FR | 2961384 | | 12/2011 | |
| FR | 2 963 215 | | 2/2012 | |
| FR | 2 993 151 | | 1/2014 | |
| FR | 3006566 | | 12/2014 | |
| FR | 3014656 | A1 * | 6/2015 | A45D 40/265 |
| FR | 3028152 | | 5/2016 | |
| WO | WO 2008/113939 | | 9/2008 | |
| WO | WO-2009037608 | A3 * | 11/2009 | A45D 40/26 |
| WO | WO 2010/149366 | | 12/2010 | |
| WO | WO 2011/152927 | | 12/2011 | |
| WO | WO 2012/085398 | | 6/2012 | |
| WO | WO 2015/092586 | | 6/2015 | |
| WO | WO 2015/110853 | | 7/2015 | |
| WO | WO 2015/171167 | | 11/2015 | |
| WO | WO 2016/042216 | | 3/2016 | |
| WO | WO 2016/071489 | | 5/2016 | |
| WO | WO 2017/021620 | | 2/2017 | |

OTHER PUBLICATIONS

Document dated May 14, 2018 and submitted with Third Party Observation regarding PCT Priority Application No. PCT/FR2016/051372 dated Jun. 2, 2018.
Third Party Observation regarding PCT Priority Application No. PCT/FR2016/051372 dated Jun. 2, 2018.

* cited by examiner

APPLICATOR DEVICE FOR APPLYING A FLUID OR PASTY PRODUCT TO KERATIN FIBRES

This application claims priority to International Application No. PCT/FR2016/051933 filed Jul. 25, 2016 and to French Patent Application No. 1557408 filed Jul. 31, 2015; the entire contents of each are incorporated herein by reference.

TECHNICAL FIELD OF INVENTION

The invention relates to the field of applicators for applying a fluid or pasty product to keratin fibers such as eyelashes or eyebrows. In particular, the applicators targeted by the invention make it possible to apply a cosmetic, makeup or skin care product on hair, eyelashes or eyebrows.

Such applicators essentially comprise two elements: one core having an elongated shape, whereon at least one row of teeth or spikes is provided.

STATE OF THE ART

Many documents are known, which disclose products of this type which primarily aim at making it possible to easily, simply and reliably fill and then apply the suitable product, with a harmonious result. In the field considered, such applicator is said to have to perform a filling function, a separating function, a defining function or still a curling function.

For some time already, a makeup brush with a support whereon bristles are individually and regularly attached, is known, for example from the document FR 2,505,633. According to one characteristic of this invention, the support and the bristles are obtained by injecting a moldable material.

By way of illustration still, the document FR 2850549 discloses a brush for applying a product on keratin fibres, which comprises a core bearing bristles, at least a part of which extend in a curved manner.

One applicator comprising a core and at least two rows of teeth, each oriented differently relative to an outer surface of the core, is also known from the document FR 2902984. This type of applicator is intended to improve the application of a product, especially as regards the penetration of the teeth between the eyelashes or otherwise, the smoothing of the product on the eyelashes and the separation thereof.

One applicator device for adjusting and/or controlling the flexibility of the teeth that it is made of is also known from the French patent application FR 10 56316; such device thus consists of a core and several rows of spikes; a first series of spikes extends from the core to a longitudinal stem, whereas a second series of spikes has a first end connected to the stem and a second free end. This type of applicator makes it possible to adjust and/or control the flexibility of the teeth (or spikes). However, such applicator lacks radial flexibility; it cannot be much deformed radially, which is a disadvantage when it comes to making it go through an annular element called a wringer positioned at the outlet of the container for the product to be applied. As a matter of fact, the "fill", i.e. the amount of product on the device is not optimum and may be insufficient for a correct application onto the eyelashes, with such a known device.

Besides, a one-piece fluid applicator device is known from WO 2012/085398, which typically comprises at least one longitudinally oriented resilient and flexible stem embedded in at least a first and a second point on said longitudinal core, so as to provide at least one bending area perpendicular to the longitudinal axis XX. When compared to the known devices, this applicator is an improvement as regards the fill and the application of the product since the flexible stem(s), also known as "arches", has/have some mobility, is/are more deformable and thus contain(s) a variable amount of product.

This technical effect is much appreciated by the users; but a technical limit seems hard to cross as far as the manufacturing and feasibility of such brushes are concerned. As a matter of fact, the applicator according to document WO 2012/085398 is made in one piece i.e. molded in one piece.

DISCLOSURE OF THE INVENTION

The invention aims at remedying the disadvantages of the prior art and in particular at providing an applicator with improved properties, especially as regards the modulation of the fill, and in one-piece i.e. made in a single molding step with two or three materials.

The present invention relates to a one-piece applicator device for applying a fluid or pasty product to keratin fibers, comprising a core that extends along a longitudinal axis XX and at least one flexible stem that is embedded at at least a first and a second point along the longitudinal core, with said stem extending substantially along the longitudinal axis XX, with spikes being provided on the core and/or on said at least one stem.

According to a first aspect of the invention, said core is provided with at least one radial through-opening and said at least one flexible stem extends substantially in a radial plane and has at least a first and a second curve along its length, such that said stem crosses said at least one opening without contact in order to ensure mobility in a radial plane of the device.

The term "radial through-opening" means an opening going right through the core, which generally extends in a radial plane of the device.

In the remainder of this text, "stem" or "arch" will be used interchangeably. As will be understood with reference to the following text, the stem has a characteristic shape.

The mobility of the stem(s) is thus greater than in the prior art specifically because of the presence of the central opening wherein the stem(s) can move.

According to the invention, said at least one stem has at least two similarly oriented curves. Of course said stem belongs to a radial plane.

According to one characteristic embodiment of the invention, the device comprises two flexible stems extending in two distinct radial planes. The flexible stems intersect at the radial through-opening.

Besides, the device may comprise at least one additional stem, both ends of which are embedded at the distal end of the device. Some kind of loop is thus provided at the distal end of the device, the function of which will be explained hereunder. The distal end is understood to be the free end of the device, opposite the proximal end, which the axis or the holding grip of the applicator is generally attached to.

Interestingly, the cross section of the core may be variable along the longitudinal axis XX.

According to one embodiment of the invention, the one-piece device comprises at least one radially oriented spike able to modify the shape of the opening if an axial force is applied at the distal end of the device.

According to one embodiment of the invention, at least one of said stems is S-shaped and substantially extends along the whole length XX of the device.

According to another embodiment of the invention, the device comprises a stem, the shape of which is defined by a first curve which extends along the length of the device, by a double curve and by a connection between said curves, with said connection being positioned at said core opening. The first curve and the double curve belong to the same radial plane. The complex shape of such a stem, however, can be molded with the rest of the device. The advantage of this embodiment lies in that it enables at least two different types of makeup, as will be explained below in connection with the illustrated embodiments.

Furthermore, according to this embodiment, the connecting element has a spike oriented radially and perpendicularly to the plane of the stem, with said spike being able to cooperate with one edge of the core in order to hold the stem in a given position.

In addition, according to a particular embodiment of the invention, said at least one stem has three successive curves similarly oriented along the axis XX and separated by two inflection points.

BRIEF DESCRIPTION OF THE FIGURES

Other characteristics and advantages of the invention will emerge upon reading the description which follows, while referring to the appended figures, which illustrate.

For clarity, identical or similar elements are identified by the same references on all the figures.

DETAILED DESCRIPTION OF ONE EMBODIMENT

Figure 1:
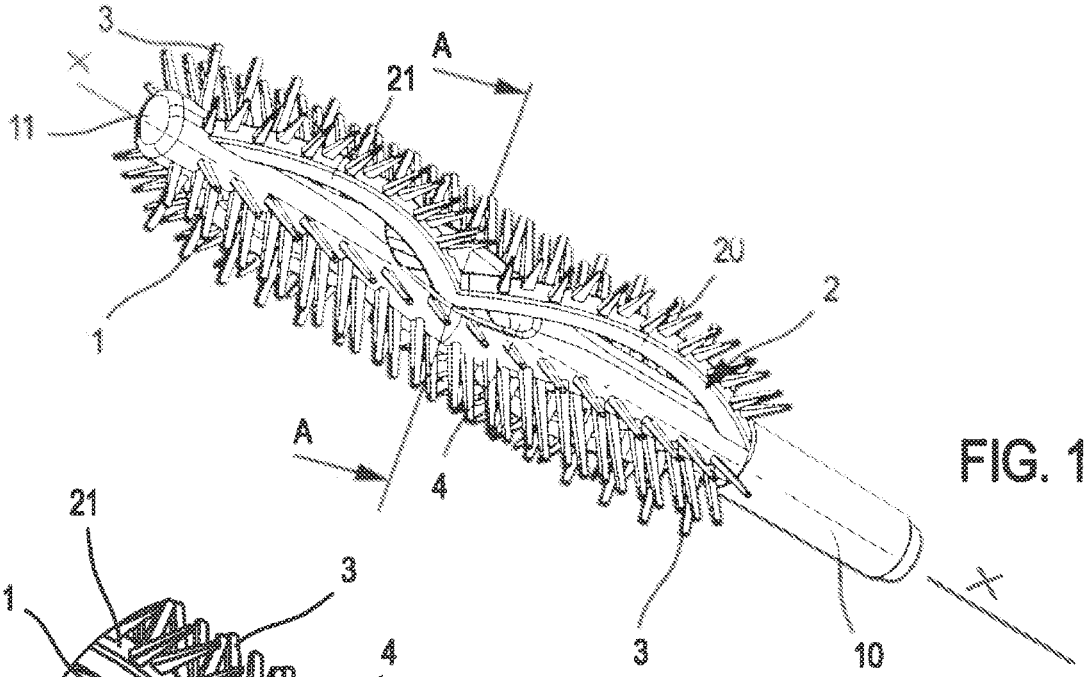
FIG. 1, a perspective view of a first embodiment of the invention.

FIG. 1 illustrates, in a perspective view, a first embodiment of the invention, wherein the one-piece device, capable of applying a liquid or pasty product to keratin fibers, comprises a core 1 which extends along a longitudinal axis XX; the core 1 has a proximal end 10 close to and cooperating with a gripping stem (not shown), and a free distal end 11. At least one flexible stem 2 is further provided, and embedded at at least a first and a second point on the longitudinal core 1. The embedding points are here positioned close to the respectively proximal and distal ends of the core 1. Embedding has the usual mechanical meaning, i.e. a connection without any degree of freedom.

FIG. 1 also shows spikes 3 provided on the stem(s) 2 as well as on the core 1. The person skilled in the art will determine the relevance of the presence of such spikes 3; he/she will also determine the density and the orientation thereof, more or less empirically. The length of the device, as measured along the axis XX, may range from ten to thirty millimeters, and the outer diameter thereof ranges from five to fifteen millimeters.

The flexible stem 2 extends in a radial or longitudinal plane, i.e. perpendicular to a transverse plane of the device; it has a shape specifically designed to increase its flexibility especially in the radial plane. Furthermore, at least one opening 4 is provided in the core 1. The opening is a radial through-opening i.e. it goes right through the core 1 and it is oriented along a radial plane. The shape of the opening is generally elongate along the longitudinal axis XX. It is so positioned as to efficiently cooperate with the stem(s) 2 having a specific shape.

According to the invention, "flexible stem" means an element extending along the axis XX, resilient and movable essentially in a radial plane.

Figure 2:
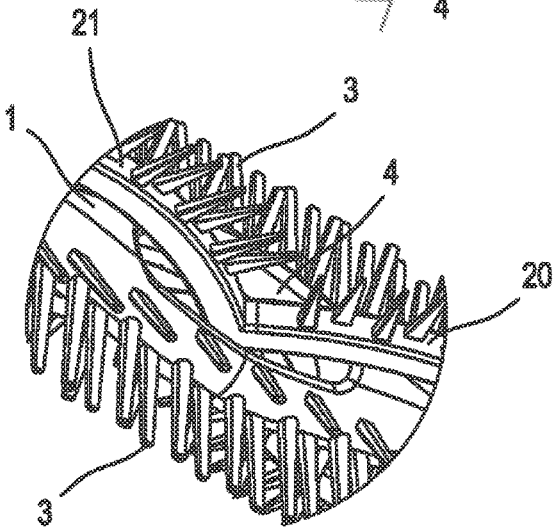
FIG. 2, an enlarged view of the first embodiment at the opening in the core.

According to the embodiment of the invention shown in FIG. 1, and FIGS. 2 to 4, the stem 2 has a first 20 and a second similarly oriented curves 21, along its length, between its two embedded ends; the first curve 20 and the second curve 21 are therefore oriented in the same direction and they follow one another along the length of the stem 2. The first and second curves meet (in this case substantially in the middle of the length of the core 1) at the opening 4 provided in the core 1, at a point of inflection. There, the stem 2 goes through the opening 4 without contact. FIG. 2 shows this characteristic and interesting arrangement in greater details.

Figure 3:
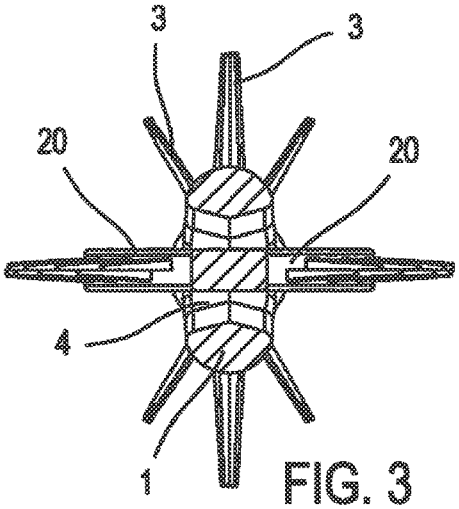
FIG. 3 is a section along AA in FIG. 1.

Besides, FIG. 3 shows that a second stem 2 as described above is provided in the same radial plane as the stem described above, but positioned 180° therefrom. The two curves 20, 21 of the second stem 2 meet at the same level as the curves of the first stem 2, i.e. in the opening 4; there is no contact between the junction area of the curves 20, 21 of the second stem 2 and the walls of the opening 4. This arrangement enables the stems 2 to be movable in their radial plane, with significant amplitude, i.e. significantly higher than if no opening 4 is provided for. The opening 4, as combined with the shape and the specific orientation of the stems 2, thus results in a technically interesting characteristic. As a matter of fact, the mobility of the stems 2 enables an easy filling of the device with a liquid or pasty product. Such mobility also makes it possible to spread said liquid more evenly because the force exerted onto the keratin fibers is more homogeneous, too. Furthermore, the mobility and flexibility provided by the invention enable an easier passage through the orifice and the wiper of the fluid container, which the applicator goes through a very large number of times in the direction of translation and in the other direction.

Figure 4:
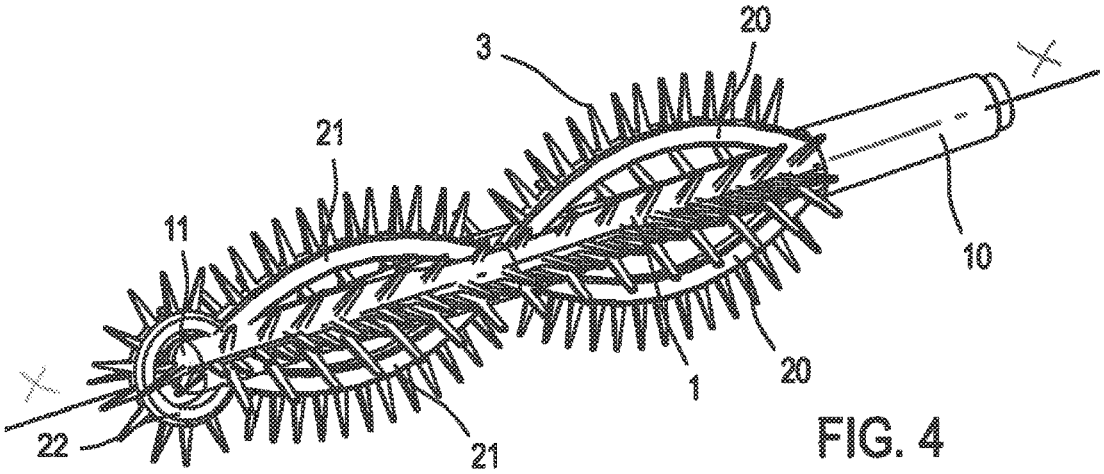
FIG. 4, a variant of the first embodiment of the invention, seen in perspective from the side.

FIG. 4 shows one embodiment of the invention which differs from that of the previous figures by the presence of an additional stem 22, both ends of which are embedded at the distal end 11 of the core. A circular shape is thus given to the additional stem 22; preferably the additional stem 22 is in the same radial plane as the two stems 2, although this provision is not compulsory. Several additional stems of this type but extending in different planes can be provided within the scope of the invention. Realistically, one to six additional stems may be provided.

Figure 5:
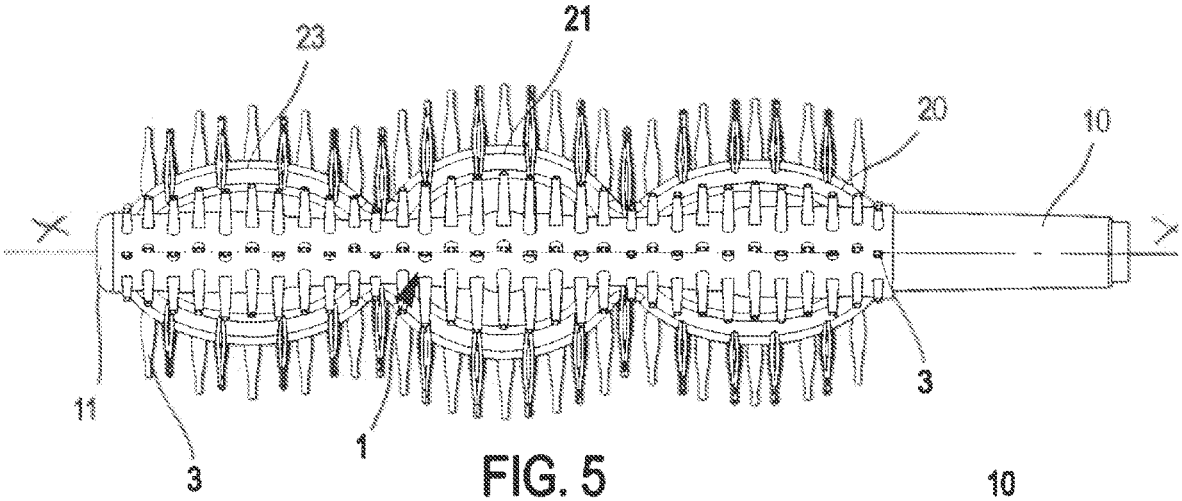
FIG. 5, a perspective view from the side of a second embodiment of the invention.

FIG. 5 corresponds to a second embodiment of the invention which differs from the first embodiment by the presence of three curves 20, 21, 23 of each stem 2, instead of two. This side view clearly shows that the two stems 2 belong to the same plane and that the curves meet at the core 1. This figure does not show the opening(s) 4, in the core 1. Each opening has the characteristics mentioned above as well as the positioning thereof relative to the area where the curves of the stems 2 meet. The person skilled in the art will select the best adapted embodiment according to the dimensions of the device, and according to the materials used.

Figure 6:
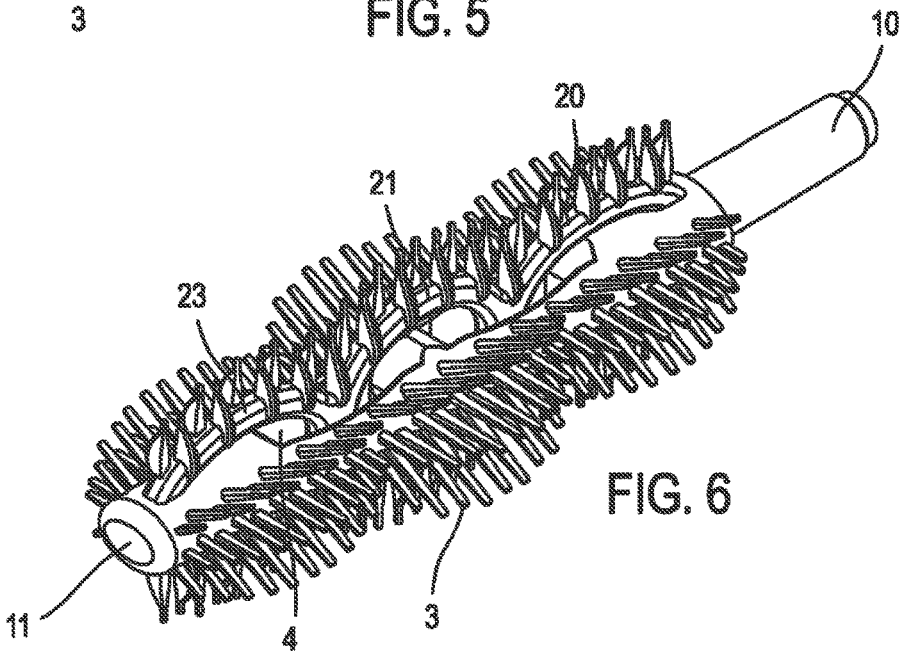
FIG. 6, another perspective view of the second embodiment of the invention.

The perspective of FIG. 6 makes it possible to view the through-opening(s) 4 provided in the core and adapted to cooperate with the stems 2, in particular with the curves 20, 21, 23 of these stems and the junction areas thereof. This embodiment therefore comprises stems having a greater flexibility than in the first embodiment since the opening 4 is larger. This embodiment provides the user with more accuracy when applying the product to the keratin fibers. As a matter of fact, as each vertex of a wave is clear, i.e. away from the other peaks, the spikes located in this area enable a more accurate (spot) work on the outer edges of the strip formed by the eyelashes, as well as the smaller lower lashes.

Figure 7:
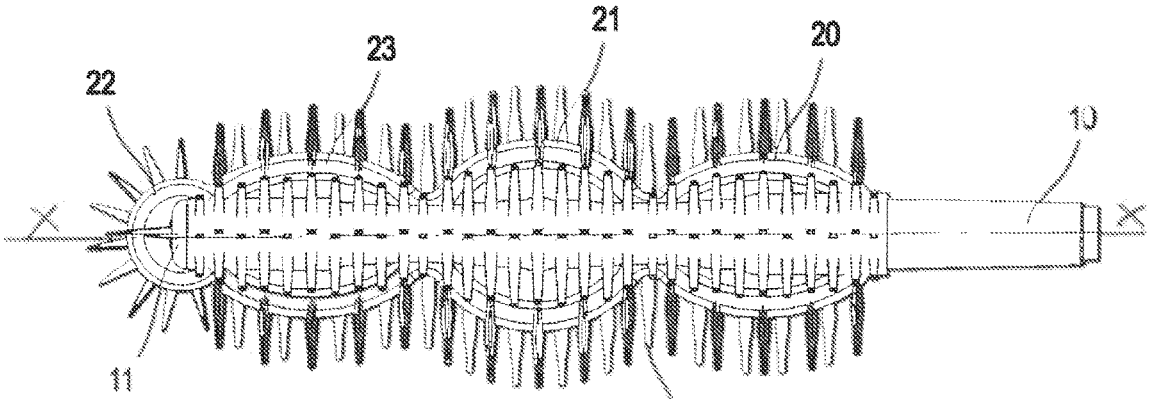
FIG. 7, a variant of the second embodiment of the invention, as seen from the side.

FIG. 7 relates to one embodiment similar to that of FIG. 6 but which provides for an additional stem 22 similar to that of FIG. 4. It aims here at showing that various combinations are possible without departing from the scope of the invention.

Figure 8:
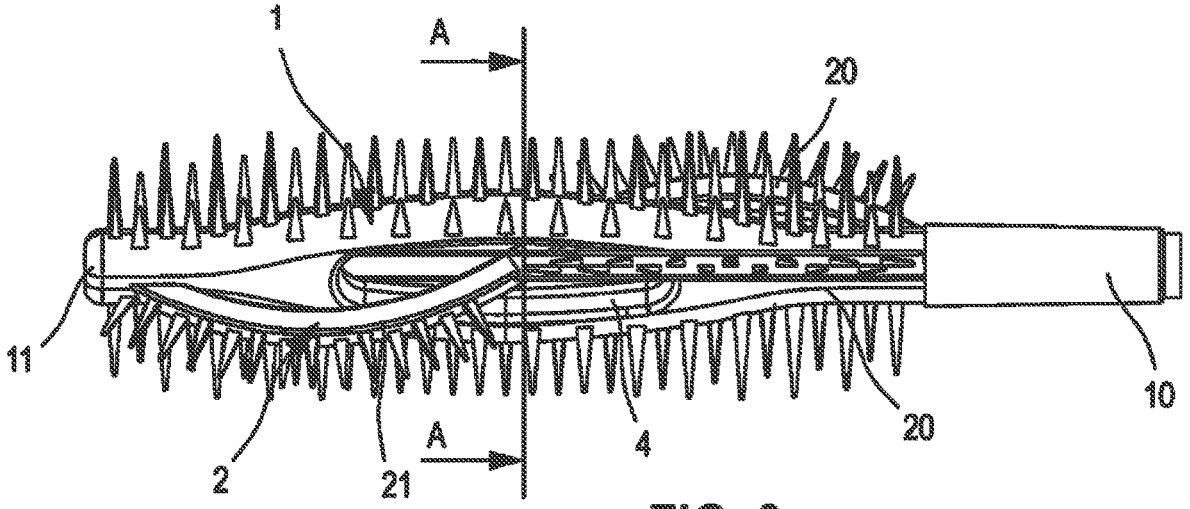
FIG. 8, a side view of a third embodiment of the invention.
Figure 9:
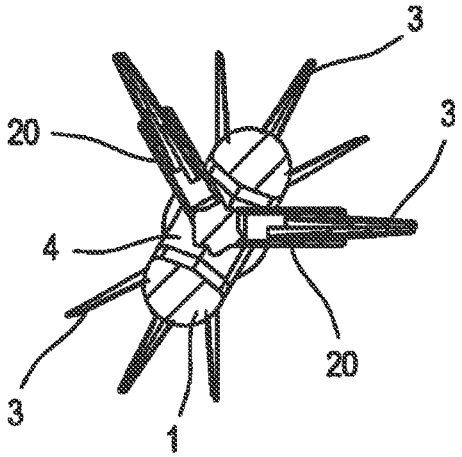
FIG. 9, a section along AA in FIG. 8.
Figure 10:
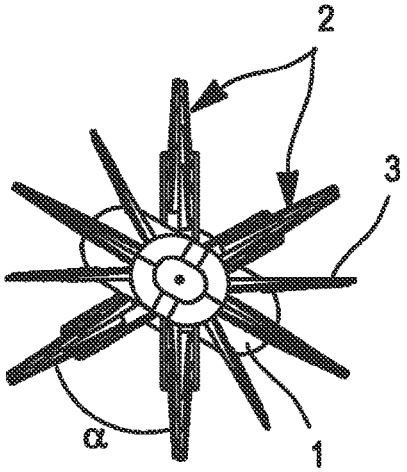
FIG. 10, a front view of the device according to the third embodiment.

FIGS. 8 to 10 illustrate a third embodiment of the invention, wherein two stems are present, each one being S-shaped. Similarly to the previous embodiments, the stems 2 meet at the opening 4 in the core 1. With the section along AA of FIG. 8, FIG. 9 shows the first curve 20 of each stem 2; this figure also shows the presence of spikes 3 both on the core 1 and on the stems 2. This presence is not compulsory. The front view given in FIG. 10 in particular shows that the two stems 2 provided here belong to two different radial planes forming an angle of about 60°. The person skilled in the art will choose the angle according to the scenario envisaged. The angle commonly ranges from about 30° to 80°.

Figure 11:
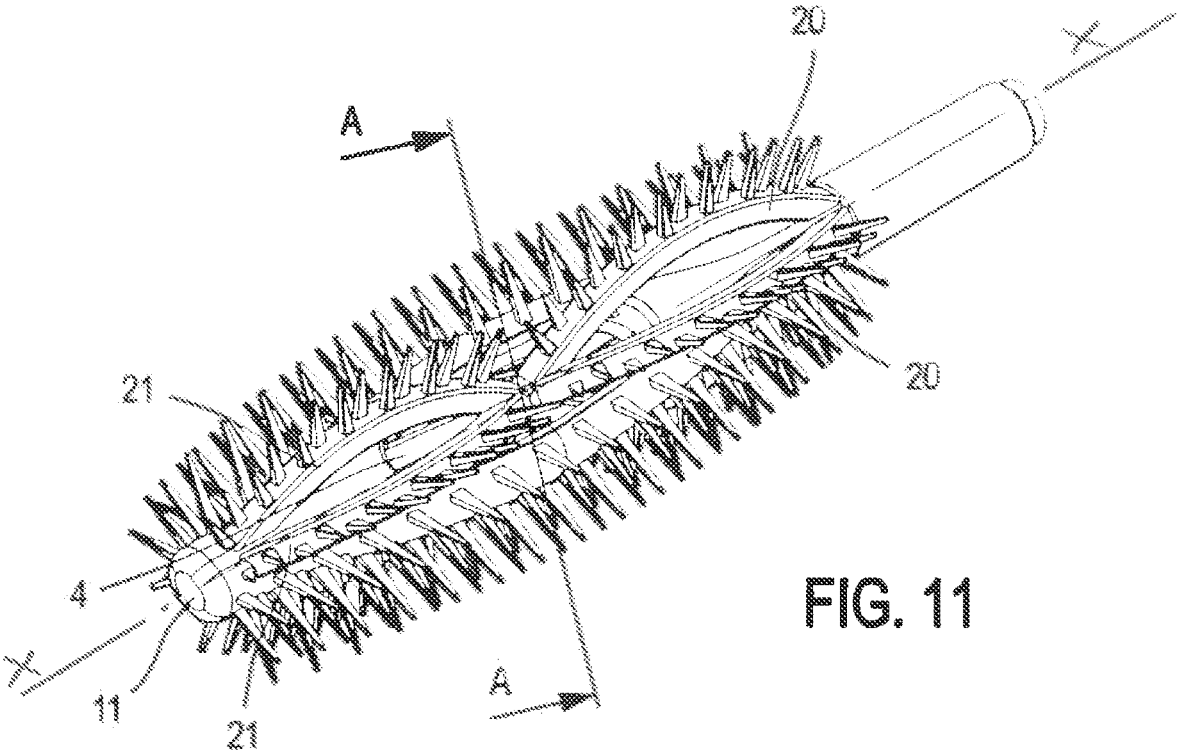
FIG. 11, a perspective view of a fourth embodiment of the invention.
Figure 12:
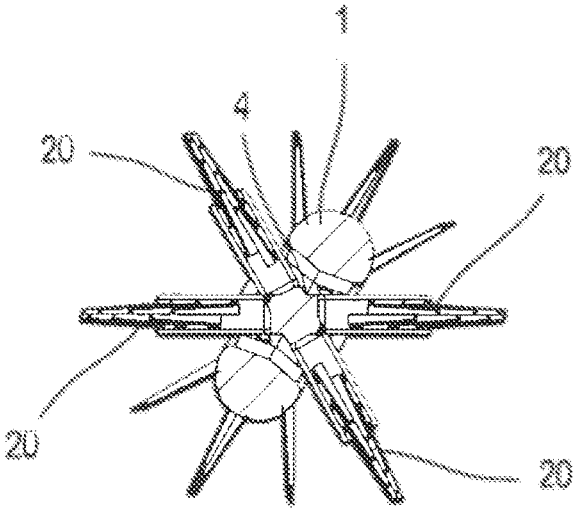
FIG. 12, a section along AA in FIG. 11.

FIGS. 11 and 12 relate to another (a fourth) embodiment of the invention, wherein two stems 2 are provided for, each being S-shaped and in a given radial plane. The two stems of course intersect at the opening 4 which they are movable in. The cross section of FIG. 12, at the opening 4, makes it possible to clearly see the junction area of the stems 2 that form here together a mobile and flexible element.

Figure 13:
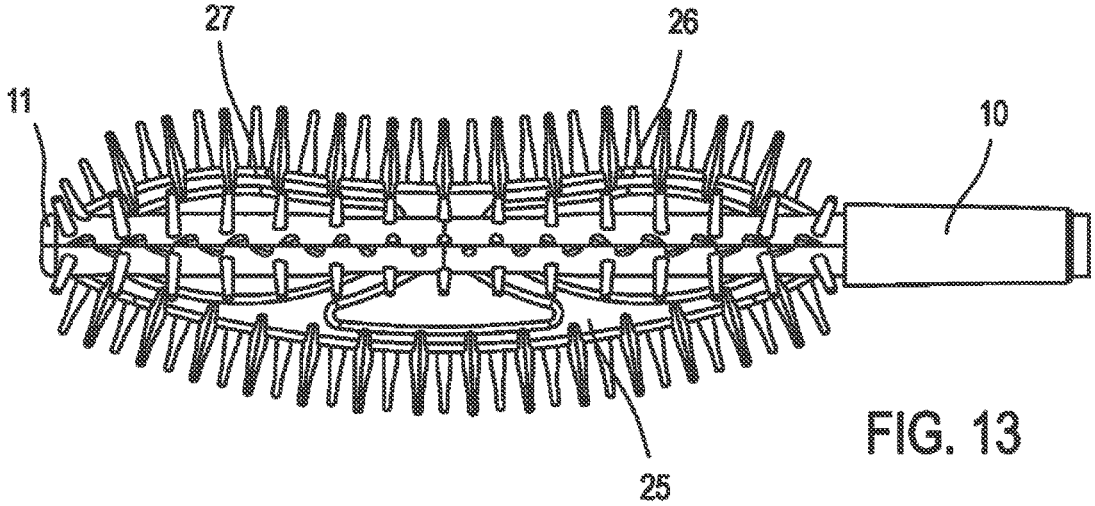
FIG. 13, a side view of a fifth embodiment of the invention.
Figure 14:
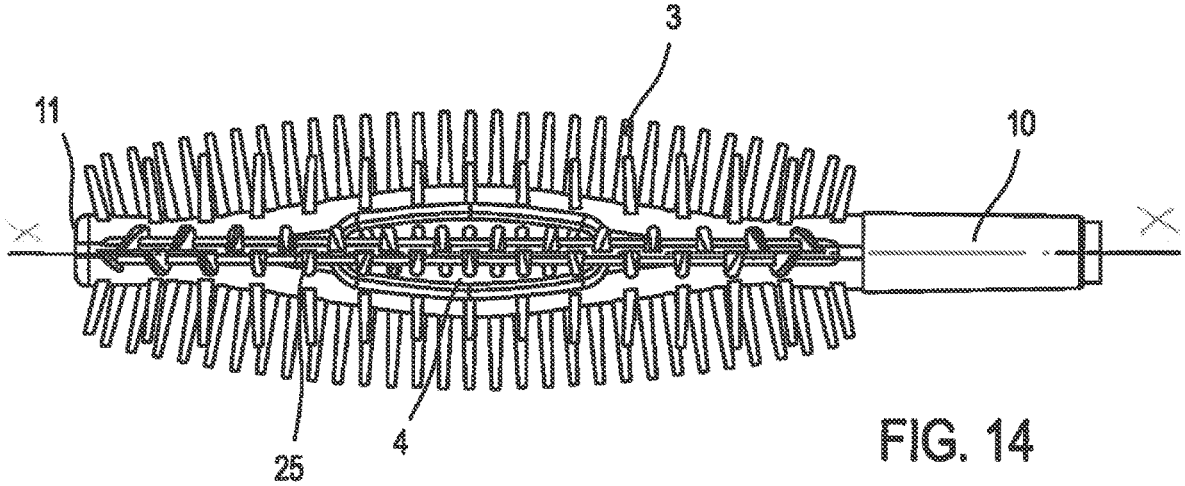
FIG. 14, another side view of the fifth embodiment of the invention.
Figure 15:
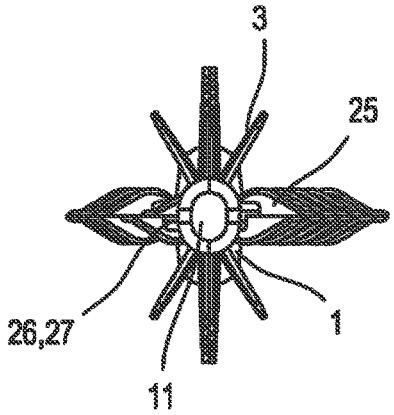
FIG. 15, a front view of the fifth embodiment of the invention.

FIGS. 13 to 15 show another (a fifth) embodiment of the invention, wherein the movable assembly or stem has a particular shape defined by a first curve 25 which extends substantially along the entire length of the device and by a double curve 26, 27 provided in the same radial plane but the convexity of which is opposite that of the first curve 25. The connection between the first curve 25 and the double curve 26, 27 is provided at the opening 4 which enables the assembly to move in the radial plane thereof. FIG. 14, which is a 90° view of FIG. 13, makes it possible to see the opening 4 in the core 1, at the connecting area of the curves 25 and 26, 27 of the movable assembly or stem 2. FIG. 15 is a front view of the same embodiment and makes it possible to confirm that the mobile assembly or stem 2; 25, 26, 27, belongs to the same radial plane.

Depending on the type of eyelashes to be treated, a particular embodiment is preferred.

Figure 16:
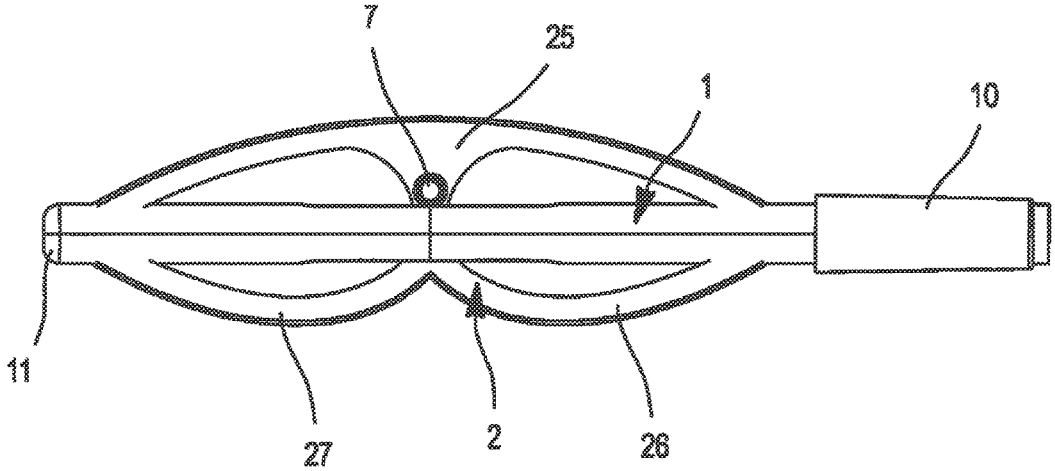
FIG. 16, a diagram of a particular shape of the stem with a spike in a first position, according to the fifth embodiment of the invention.
Figure 16A:
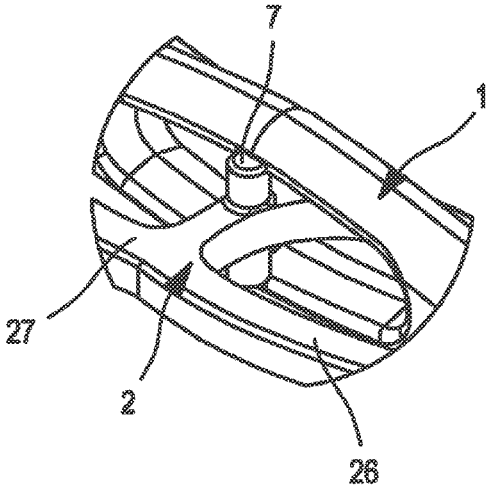
FIG. 16A, an enlarged view of the area including a spike in said first position.
Figure 16B:
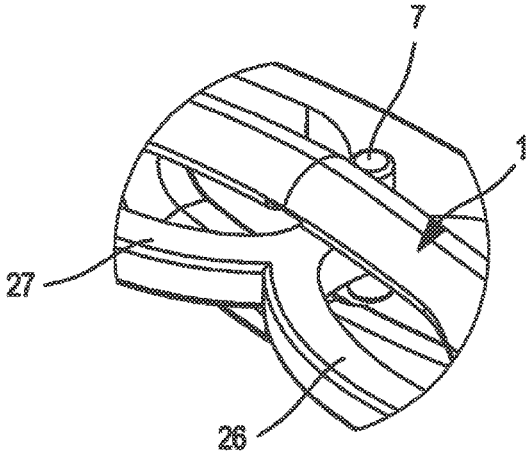
FIG. 16B, an enlarged view of the area including a spike in a second position, according to the fifth embodiment of the invention.
Figure 16C:
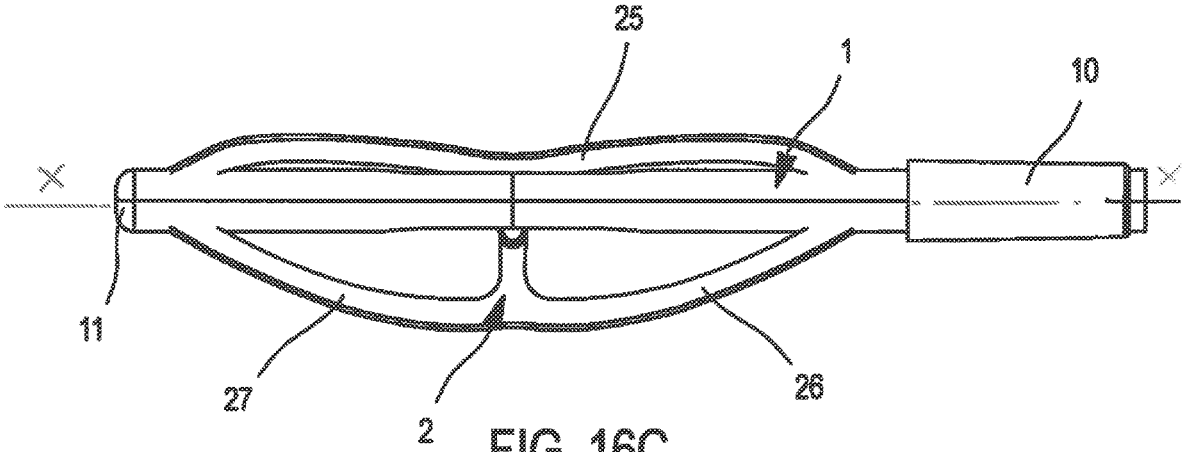
FIG. 16C, a diagram of a particular shape of the stem including a spike in a second position, according to the fifth embodiment of the invention.

FIGS. 16, 16A, 16B and 16C schematically illustrate a variant of the fifth embodiment. As a matter of fact, it can be seen in these figures that the mobile assembly or stem 2; 25, 26, 27 comprises a lug 7 oriented radially and perpendicularly to the own radial plane thereof. The lug 7 is adapted to cooperate with an edge of the core 1 in order to hold the stem 2; 25, 26, 27 in a given position. FIG. 16 illustrates the lug 7 in contact with one edge of the core 1, whereas FIG. 16C illustrates the lug 7 in contact with another edge of the core 1. A slight deformation of the stem 2, resulting from the intrinsic flexibility thereof can be seen between the two positions. The stem is thus held in a desired stationary position, which enables a fuller work capable of further stretching the fluid product. When slightly and laterally pressing the lug 7, the geometry of the curves or arches 25, 26, 27 changes so that a different make-up work can be operated.

Figure 17:
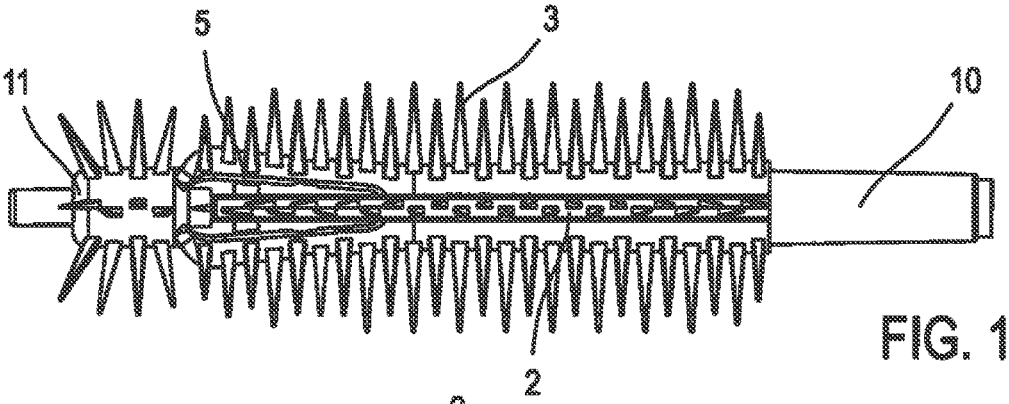
FIG. 17, a side view of a sixth embodiment of the invention in a first position.
Figure 17A:
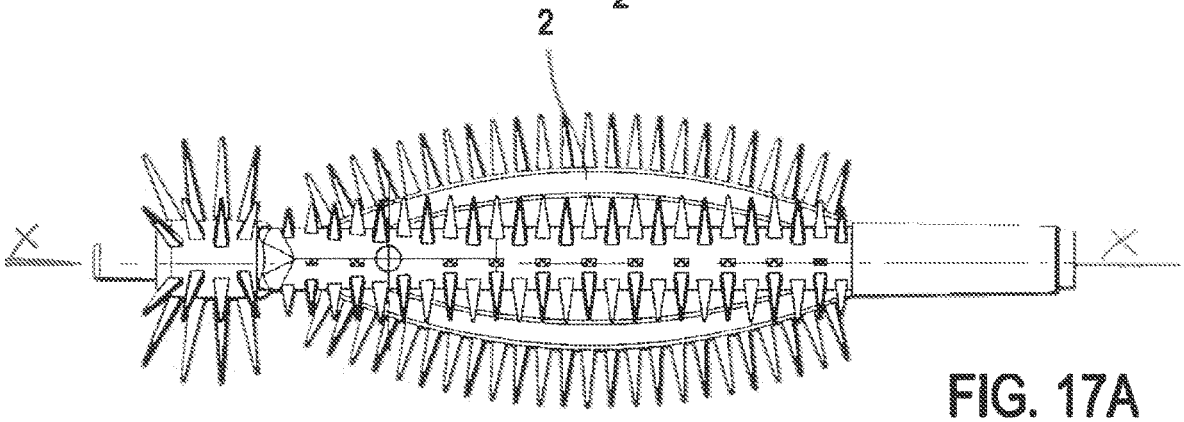
FIG. 17A is another side view of the sixth embodiment of the invention, in a first position.
Figure 18:
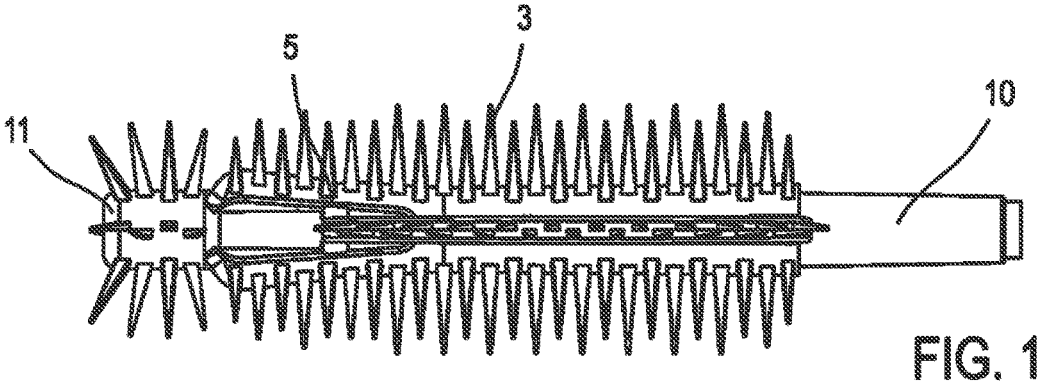
FIG. 18, a side view of a sixth embodiment of the invention in a second position, and FIG. 18A, another side view of the sixth embodiment of the invention in the second position.
Figure 18A:
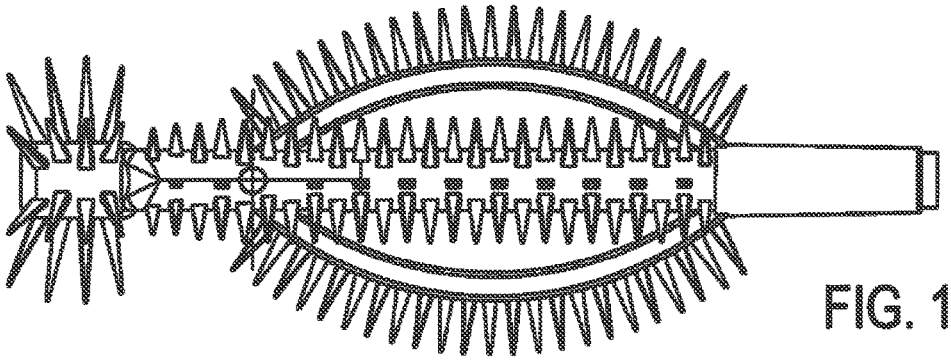

Another interesting effect can be obtained with the embodiment illustrated by FIGS. 17, 17A and 18, 18A. According to this embodiment of the invention, a lug 5 is provided on the stem 2, radially oriented and adapted to change the shape of the opening 4 in the core 1. FIGS. 17 and 17A show the lug 5 substantially positioned at one end of the opening 4, whereas FIGS. 18 and 18A show the lug 5 located towards the other end of the opening 4. Thus, by pressing the tip of the device, at the distal end 11 thereof, the user changes the shape of the opening 4 as shown in FIGS. 17 and 18; as well as the curve of the stem 2 as shown in FIGS. 17A and 18A. This embodiment makes it possible to obtain two different profiles, and thus to obtain two substantially different types of application. A point of no return makes it possible to hold the position. The passage of the applicator through the neck of the container, when re-entering the container, enables the return to the initial position (according to FIGS. 17 and 17A).

Besides, the specificity and characteristics of the stems 2 (whether single, double, having one or more curves or undulations) are reinforced by the general flexibility obtained by the passage through the radial through-opening(s) 4. Thus, the user obtains a more comfortable and precise makeup; the approach to and positioning on the base of the eyelashes are facilitated by the flexibility imparted to the stem(s) 2 provided with spikes 3.

Furthermore, as the stems 2 are not attached to the core at the through-opening(s) 4, they are very flexible. The motion range of the stems is interesting in that it offers new features for the makeup.

The present invention, however, has a continuous central core 1 along its length; the section of the central core 1 has one or more through-opening(s) 4 for the passage of the stems, or more precisely for the passage of the connecting areas between the curves of the stems 2. The one-piece device of the invention thus has a sufficiently rigid structure to go through the wiper member usually provided at the fluid container neck without deformation or damage, for very numerous passages.

It should interestingly be noted that the device according to the invention, unlike the prior art, is molded in one piece; production time is thus saved. High dimensional accuracy is guaranteed, as well as a perfect control of all the constituent forms of the applicator of the invention. The advantages of the invention are considerable and the various embodiments enable various uses, perfectly suited to both the type of keratin fibers to be treated, to the nature of the fluid to be applied and to the make-up mode desired by the user.

The invention claimed is:

1. A one-piece applicator device for applying a fluid or pasty product to keratin fibres, comprising:

a core that extends along a longitudinal axis (XX) and provided with at least one radial through-opening, at least one flexible stem that is embedded at at least a first and a second point along the longitudinal core and that extends substantially along the longitudinal axis (XX) in a radial plane of the device, spikes provided on the core and/or on the at least one flexible stem, wherein the at least one flexible stem has at least a first and a second curve along its length such that the at least one flexible stem extends into the at least one radial through-opening without contact to ensure mobility of the at least one flexible stem in the radial plane.

2. A one-piece applicator device according to claim 1 wherein the at least one flexible stem has at least two curves.

3. A one-piece applicator device according to claim 1 wherein the at least one flexible stem comprises at least two flexible stems that extend in two distinct radial planes.

4. A one-piece applicator device according to claim 1 further comprising at least one distal stem having at least two ends with each end being embedded at a distal end of the device.

5. A one-piece applicator device according to claim 1 wherein a cross section of the core varies along the longitudinal axis (XX).

6. A one-piece applicator device according to claim 1 further comprising at least one radially oriented lug configured to modify the shape of the radial through-opening if an axial force is applied at a distal end of the device.

7. A one-piece applicator device according to claim 1 wherein the at least one flexible stem is S-shaped and substantially extends entirely along the length of the device.

8. A one-piece applicator device according to claim 1 wherein the at least one flexible stem has a shape defined by a first curve that extends along the length of the device, by a double curve, and by a connection between the curves, with the connection being positioned at the radial through-opening.

9. A one-piece applicator device according to claim 8 further comprising a lug oriented radially and perpendicularly to a plane of the at least one flexible stem, with the lug configured to cooperate with at least one edge of the core to hold the at least one flexible stem in a given position.

10. A one-piece applicator device according to claim 1 wherein the at least one flexible stem has three successive curves oriented along the longitudinal axis (XX) and separated by two inflection points.

* * * * *